US005803053A

United States Patent [19]

Pflieger et al.

[11] Patent Number: 5,803,053

[45] Date of Patent: Sep. 8, 1998

[54] METHOD AND ARRANGEMENT FOR SUPPLYING FUEL VAPOR TO AN INTERNAL COMBUSTION ENGINE

[75] Inventors: Helmut Pflieger, Obersulm; Georg Mallebrein, Singen, both of Germany

[73] Assignee: Robert Bosch GmbH, Stuttgart, Germany

[21] Appl. No.: 822,683

[22] Filed: Mar. 24, 1997

[30] Foreign Application Priority Data

Mar. 23, 1996 [DE] Germany ..... 196 11 521.3

[51] Int. Cl.[6] ..... F02M 37/04

[52] U.S. Cl. ..... 123/516; 123/520; 123/531

[58] Field of Search ..... 123/516, 520, 123/521, 518, 519, 531, 533

[56] References Cited

U.S. PATENT DOCUMENTS

| | | | |
|---|---|---|---|
| 5,359,980 | 11/1994 | Tomisawa | 123/198 D |
| 5,421,311 | 6/1995 | Wataya | 123/531 |
| 5,441,032 | 8/1995 | Ikuta | 123/531 |
| 5,474,047 | 12/1995 | Cochard | 123/520 |
| 5,474,049 | 12/1995 | Nagaishi | 123/520 |
| 5,482,023 | 1/1996 | Hunt | 123/520 |
| 5,485,824 | 1/1996 | Kondou | 123/520 |
| 5,634,451 | 6/1997 | Tomisawa | 123/520 |

FOREIGN PATENT DOCUMENTS

| | | | |
|---|---|---|---|
| 2704601 | 11/1994 | France . | |
| 2207172 | 8/1990 | Japan | 123/531 |

*Primary Examiner*—Carl S. Miller
*Attorney, Agent, or Firm*—Walter Ottesen

[57] ABSTRACT

The invention is directed to a method for controlling the output of fuel vapor from a tank-venting system via a line system to intake channels of individual cylinders of a multi-cylinder engine. The line system branches to respective ones of the cylinders and has at least one controllable valve. The controllable valve alternately releases and blocks the output. The valve is so controlled that the output takes place in synchronism with the periodic repetition of the work cycles of the engine.

6 Claims, 5 Drawing Sheets

METHOD AND ARRANGEMENT FOR SUPPLYING FUEL VAPOR TO AN INTERNAL COMBUSTION ENGINE

FIELD OF THE INVENTION

The invention relates to a method and an arrangement for supplying fuel vapor from a tank-venting system of a motor vehicle to the internal combustion engine of the vehicle.

BACKGROUND OF THE INVENTION

Statutory requirements are directed to a reduction of the emission of carbon substances emitted by motor vehicles. To satisfy these requirements, the fuel vapors, which escape from the fuel tank, are first intermediately stored in an active-charcoal filter and are then conducted via a tank-venting valve into the intake pipe. Depending upon the engine operating point, and especially in low or mid load/rpm range, up to 50% of the fuel quantity required by the engine is supplied from the tank-venting system. The fuel vapor flowing over this path is referred to in the following as regenerated gas. This designation indicates that the active-charcoal filter is regenerated by the delivery of the intermediately-stored fuel so that it can accommodate fuel anew. The remaining required fuel is injected into the intake pipe via the injection valves, that is, upstream of the inlet valves of the engine.

The metering of the regenerated gas should be spatially evenly distributed so that emissions, which result from the combustion, are not disadvantageously influenced when the fuel component of the regenerating gas is high. Stated otherwise, to prevent scattering in the composition A of the air/fuel mixture from one cylinder to another, the regenerated gas should be evenly metered to the individual cylinders.

French patent publication 2,704,601 discloses a tank-venting system for an internal combustion engine, which is equipped with injection valves for which the stream of liquid fuel is surrounded by an airflow. This airflow is encircling air and effects an atomization of the fuel, which is injected forward of the inlet valve of the engine, and thereby effects an improvement of the quality of the subsequent combustion. According to French patent publication 2,704,601, this encircling air is utilized for supplying the regenerated gas to the engine. Stated otherwise, the regenerated gas is guided in a similar manner about the injection stream.

SUMMARY OF THE INVENTION

It is an object of the invention to further improve the delivery of the regenerated gas in order to achieve a uniform combustion of the regenerated gas and thereby to further reduce the exhaust-gas emissions and to further improve the efficiency of the combustion.

The method of the invention is performed in a multicylinder internal combustion engine including: a tank-venting system, a plurality of intake channels leading to respective ones of the cylinders and a line system branching to respective ones of said intake channels. The method controls the output of fuel vapor from the tank-venting system via the line system. The method includes the step of: providing metering means in the line system for metering the fuel vapor into the intake channels in synchronism with the engine revolutions.

The solution of the invention is based on the recognition that the regenerated gas, referred to a cylinder, should be delivered evenly distributed. More specifically, during operation under conditions which remain the same, a cylinder should be supplied with approximately the same quantity of regenerated gas from one work cycle to next work cycle.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
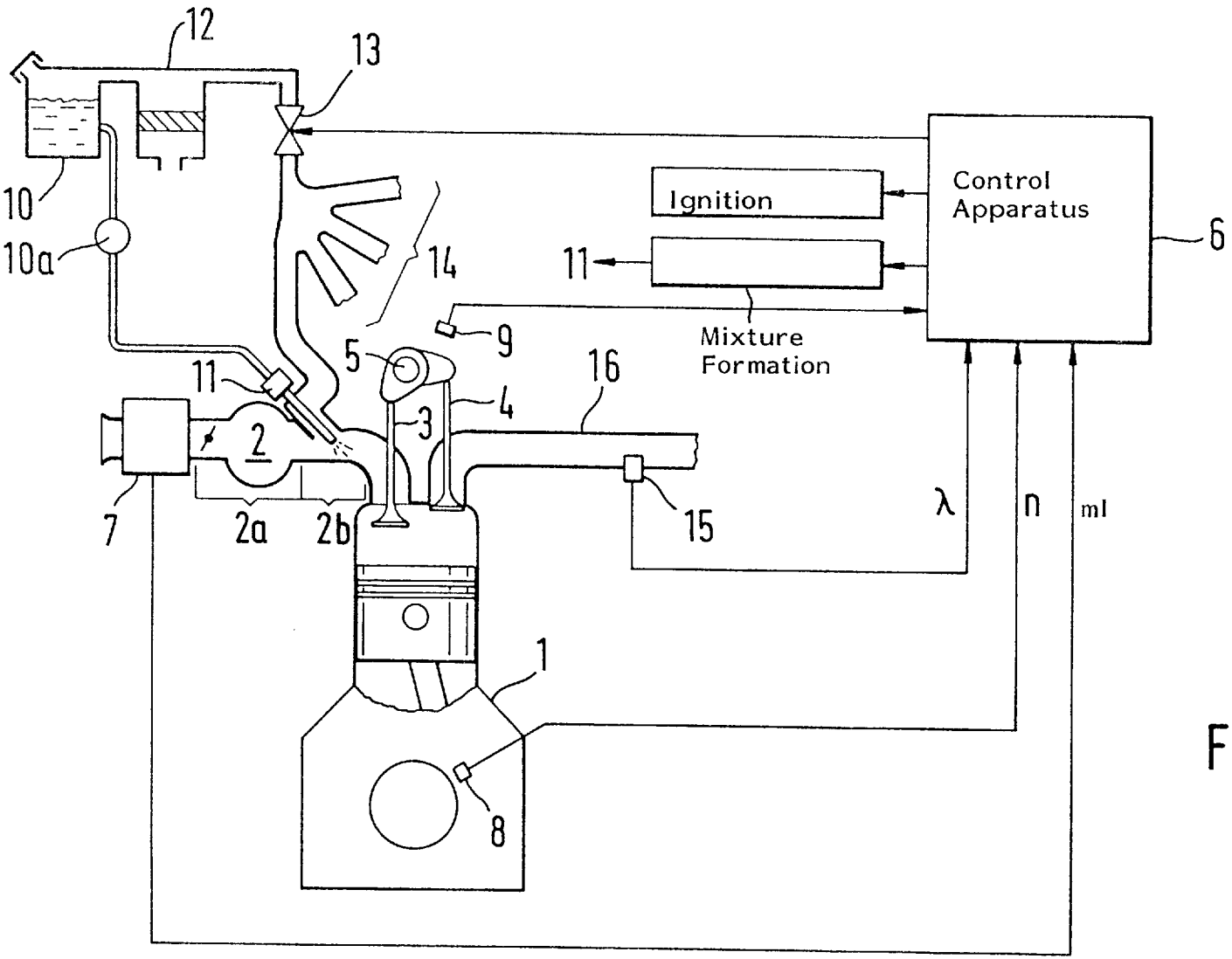
FIG. 1 is a schematic showing the technical area in which the invention is applied.

In FIG. 1, reference numeral 1 identifies a periodically operating internal combustion engine which inducts gas or a mixture of air and fuel from an intake pipe 2 via inlet valves 3. The gas or mixture is discharged as exhaust gas after the combustion via outlet valves 4. This exchange of gas is controlled by a drive mechanism 5 which can be realized, for example, as a camshaft which rotates once per work cycle. The intake pipe is subdivided into a central volume 2*a* and into intake pipe sections 2*b* which are assigned to respective individual cylinders and extend to the cylinders separately from each other. The functions, which are essential for the operation of the engine, such as ignition and mixture formation, are controlled by a control apparatus 6. For this purpose, the control apparatus 6 processes input signals representing operating parameters of the engine. As an example, the detection of the operating parameter ml (inducted air quantity) is shown detected by sensor 7 as well as the detection of rpm (n) and/or the crankshaft position via sensor 8. The camshaft angular position is detected by a sensor 9 and the composition of the air/fuel mixture is detected by sensor 15.

FIG. 1 also shows a fuel supply system which includes: a tank 10, a fuel pump 10*a*, a metering device 11 for liquid fuel, an intermediate storage device 12, a tank-venting valve 13, a line system 14 between the individual induction channels and the intermediate storage device. The line system 14 is shown branched for individual cylinders. The exhaust-gas probe 15 is shown mounted in an exhaust-gas pipe 16. The line lengths between the valve 13 and the individual openings into the intake pipe are all advantageously the same.

The metering device 11 for the liquid fuel can comprise an arrangement of injection valves which inject the liquid fuel atomized as finely as possible in the vicinity of the open or closed inlet valves 3. The drive of the injection valves is done by the control apparatus 6 and is symbolized in FIG. 1 by the mixture-formation block. Fuel, which vaporizes in the tank, is held in an intermediate store 12, for example, an active-charcoal filter, and is drawn by suction by the engine as regenerated gas when the tank-venting valve 13 is open.

An essential feature of the invention comprises alternately opening and closing the tank-venting valve so that the output of the regenerated gas takes place synchronously to the periodic repetition of the work cycle of the engine. With the synchronization of the clocked drive of the tank-venting valve with the opening of the inlet valves, an excellent time-dependent uniform distribution of the inducted regenerated gas results referred to a cylinder. More specifically, the composition λ of the air/fuel mixture of sequential combustions in a cylinder is subjected to relatively small fluctuations. In contrast, for an asynchronous drive of the tank-venting valve, comparatively large fluctuations occur. These can especially occur when the regenerated gas is introduced, as shown in FIG. 1, in the direct vicinity of the inlet valves of individual cylinders (intake pipe section 2*b*) which, for example, is the case when supplying via air encircling the injection stream.

In comparison to introducing the regenerated gas at a central location of the intake pipe 2*a,* the mixing of the fuel vapor with air in the intake pipe volume is here omitted. Stated otherwise, an asynchronous clocking of the tank-venting valve can lead to the situation wherein a cylinder inducts no regenerated gas in advance of a first combustion when the tank-venting valve is closed and then, for a second combustion with the tank-venting valve open, inducts regenerated gas. An excellent even distribution by the supply of the regenerated gas in the proximity of the inlet valve would then be obtained with the disadvantages of a deteriorated time-dependent uniform distribution. The procedure of the invention avoids this disadvantage while maintaining the advantage of the spatial even distribution.

Figure 2:
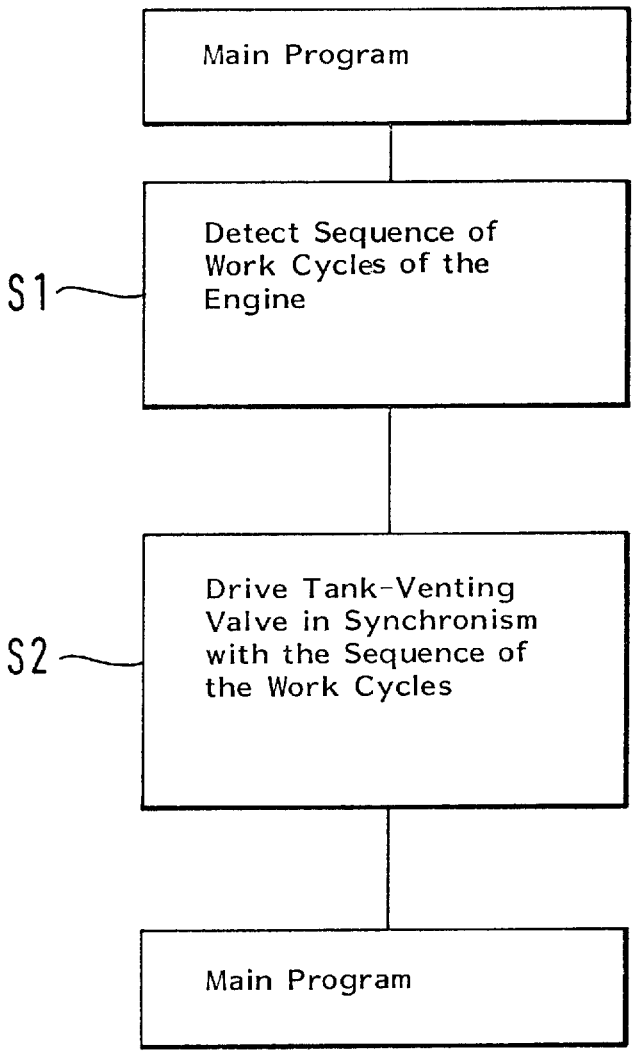
FIG. 2 shows the essence of the method of the invention in the context of a flowchart.

FIG. 2 shows the essence of the method of the invention in the form of a flowchart.

In the flowchart of FIG. 2, from a higher-order main program, step S1 is reached in which the sequence of the work cycle of the internal combustion engine is detected. The work cycle of a four-stroke engine extends over a crankshaft angular range of 720°. For this reason, for example, a detection of the angular position of the crankshaft is suitable for detecting the sequence of the work cycle as is the detection of the angular position of a camshaft, an ignition-distributor shaft, a compensating shaft or any other desired shaft driven in synchronism with the crankshaft. The above also applies for the corresponding angular range in a two-stroke engine or in a rotary-piston engine.

In the next step S2, the tank-venting valve is synchronously driven to the sequence of the work cycle; that is, for example, that the tank-venting valve is driven so as to be opened when reaching a pregiven crankshaft angle. The subsequent closing can take place in accordance with a pregiven fixed time or a time, which is dependent upon operating parameters of the engine, or even when reaching a fixed or variable pregiven crankshaft angle.

Thereafter, there is a return to the main program, which, for example, controls the ignition and mixture formation of the engine.

Figure 3:
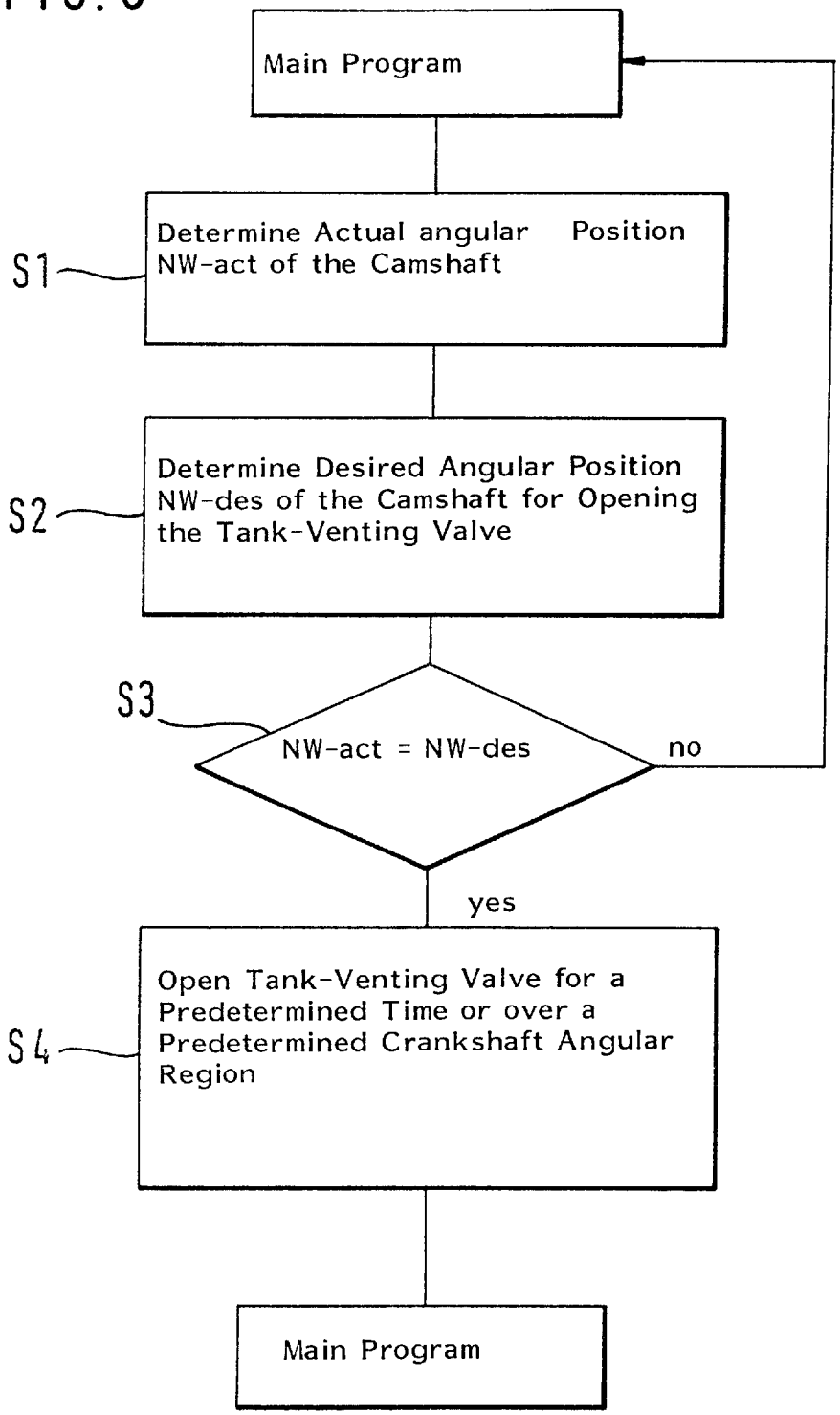
FIG. 3 shows a detailed embodiment of the invention also in the context of a flowchart.

FIG. 3 shows a detailed embodiment of this sequence. In step S1, the angular position NW-act of the camshaft is determined to detect the sequence of the work cycle of the engine. In step S2, a determination of the desired angular position NW-des of the camshaft for opening the tank-venting valve is determined. A comparison of the NW-act with NW-des takes place in step S3. If the actual value reaches the desired value, then, in step S4, the tank-venting valve is opened for a specific time or for a predetermined crankshaft angular region.

The desired angular position NW-des is preferably so predetermined that the opening of the tank-venting valve takes place in close time proximity to the opening of the cylinder inlet valve. The tank-venting valve can also be opened before the cylinder inlet valve is opened. However, this should not take place so early that the regenerated gas quantity deposited in the opening phase is distributed in the intake pipe and is inducted by an adjacent cylinder. Advantageously, the regenerated gas is metered at least during the duration of the opening of the tank-venting valve. In this way, an excellent air or gas (air containing vaporized fuel) surround of the injection stream is guaranteed. The regenerated gas quantity can be varied via the opening time duration of the tank-venting valve. In lieu of the camshaft, any other shaft is suitable which has a rotational frequency correlated to the repetition frequency of the work cycle.

Figure 4:
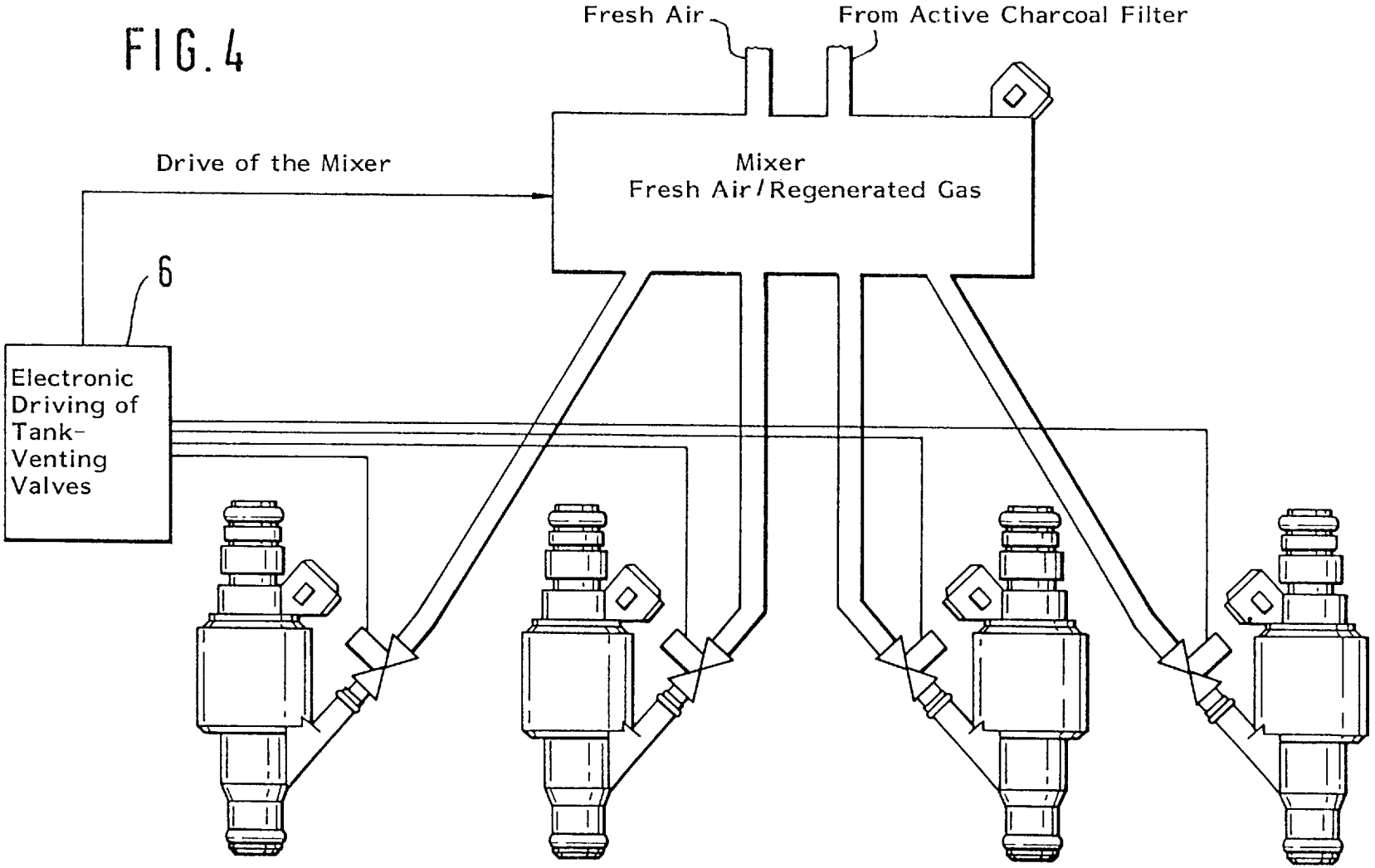
FIG. 4 is a schematic showing a first embodiment of the arrangement of the invention; and, FIG. 5 is a schematic of the arrangement of the invention incorporating a rotating distributor.

Several arrangements of tank-venting valves are conceivable for this type of injection-synchronous metering. Thus, the following are appropriate:

(a) one tank-venting valve per cylinder for a sequential, cylinder-individual injection;

(b) a tank-venting valve for a group of cylinders for group injection, that is, simultaneously driving the injection valves for a group of cylinders;

(c) a tank-venting valve for all cylinders for simultaneous injection for all cylinders; and, (d) a rotating distributor with a metering device connected upstream of the distributor and with sequential injection (see FIG. 4).

For metering regenerated gas flow, a mixing device such as shown in FIG. 4 can be used for mixing fresh air with the regenerated gas. The mixing ratio of fresh air to regenerated gas can be selected in dependence upon the desired regenerated gas volume from the active-charcoal filter. For a high fuel concentration in the regenerated gas, a great amount of fresh air can be metered thereto and, for a reduced fuel concentration, a switchover can be made for only inducting regenerated gas. The fuel concentration of the regenerated gas can, for example, be determined from the reaction of an air/fuel mixture control to the opening of the tank-venting valve or valves. The control must, for example, be appropriately leaning for high concentration, that is, correcting by reducing fuel. The influence on the fresh air quantity can be controlled by the control apparatus 6 via a valve.

The arrangement of a mixture device is shown in FIG. 4.

Figure 5:
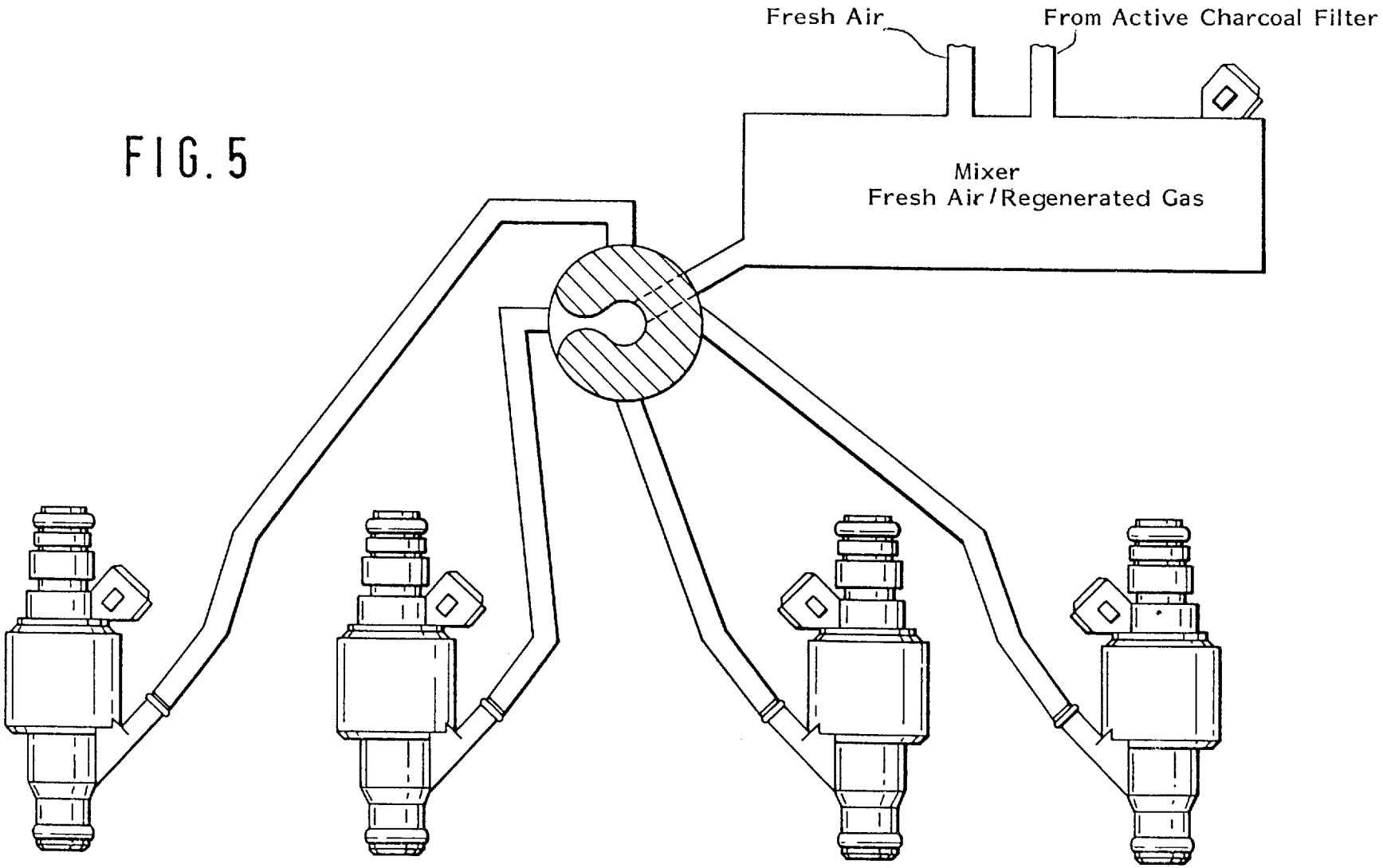

FIG. 5 shows the rotating distributor 18 referred to under paragraph (d) above and has a rotational frequency which corresponds to the camshaft frequency for a four-stroke engine and, more generally, corresponds to the frequency of the repetition of the work cycle.

Stated otherwise, the invention is directed to a method for controlling the output of fuel vapor from a tank-venting system via a line system to induction channels of a multi-cylinder engine with the induction channels being individual to each cylinder. The line system branches to respective ones of the cylinders. This method can be performed with at least one controllable valve in the line system, which alternately releases or blocks the output or whose opening cross section is at least alternately so changed that the output is synchronous to the periodic repetition of the work cycles of the engine.

A tank-venting valve can be driven open each time a pregiven crankshaft angle is reached and the subsequent closing can take place after a pregiven fixed time or a time dependent upon the operating parameters of the engine or even after reaching a fixed pregiven crankshaft angle or a variable pregiven crankshaft angle.

One possibility to variably configure the opening and/or closing comprises adapting the regenerated gas quantity to the fuel concentration in the regenerated gas. That is, for a high concentration, the tank-venting valve is so opened and/or closed that comparatively little fuel vapor is regenerated. Here, the fuel concentration in the regenerated gas can be determined from the reaction of the air/fuel mixture control to an opening of the tank-venting valve. The sequence of the work cycles of the engine can be determined via the detection of the angular position NW-act of a shaft whose rotational frequency is correlated to the repeat frequency of the work cycles. When reaching a desired angle position NW-des of the above-mentioned shaft, the tank-venting valve can be opened. The opening takes place advantageously so that the regenerated gas is metered at least during the duration of the opening of the fuel-injection valve.

It is further advantageous to use a mixture device to mix fresh air to the regenerated gas as well as the use of a rotating distributor between the mixing device and the individual cylinders. The rotational frequency of the mixing device corresponds to the frequency of the repetition of the work cycles.

It is understood that the foregoing description is that of the preferred embodiments of the invention and that various changes and modifications may be made thereto without departing from the spirit and scope of the invention as defined in the appended claims.

What is claimed is:

1. In a multicylinder internal combustion engine including a tank-venting system, a plurality of intake channels leading to respective ones of the cylinders and a line system branching to respective ones of said intake channels, a method for controlling the output of fuel vapor from said tank-venting system via said line system, the method comprising the steps of:

providing metering means in said line system for metering said fuel vapor into said intake channels in synchronism with the engine revolutions; and, metering said fuel vapor for all cylinders simultaneously at least once per work cycle of said engine.

2. The method of claim 1, wherein said tank-venting system includes a tank-venting valve defining said metering means; and, wherein the method comprises the further steps of:

driving said tank-venting valve to open when a fixed or variable pregiven crankshaft angle (0° to 720°) is reached; and, then driving said tank-venting valve to close after one of the following occurrences: after a fixed time has elapsed; after a time has elapsed which is dependent upon operating parameters of said engine; after a fixed pregiven crankshaft angle has been reached; or, after a pregiven variable crankshaft angle has been reached.

3. The method of claim 1, wherein said engine includes a fuel-injection valve; and, wherein said fuel vapor is metered during the duration of the opening of said fuel-injection valve.

4. In a multicylinder internal combustion engine including a tank-venting system, a plurality of intake channels leading to respective ones of the cylinders, a line system branching to respective ones of said intake channels and a fuel injection valve, a method for controlling the output of fuel vapor from said tank-venting system via said line system with the fuel vapor being in the form of regenerated gas containing fuel vapor in air, the method comprising the steps of:

providing metering means in said line system for metering said fuel vapor into said intake channels in synchronism with the engine revolutions during the duration of the opening of said fuel-injection valve; and, varying the closing time point of said tank-venting valve to adapt said metering to the concentration of fuel in the regenerated gas.

5. The method of claim 4, wherein the fuel concentration in said regenerated gas is determined from the reaction of a fuel/air mixture control to an opening of said tank-venting valve.

6. The method of claim 1, further comprising:

detecting the actual angular position (NW-act) of a shaft of said engine;

determining the synchronization of said metering with engine revolutions with the aid of the detection of said actual angular position (NW-act);

correlating the rotational frequency of said shaft with the repetition frequency of the work cycle of said engine; and, comparing said actual angular position (NW-act) to a desired angular position (NW-des) of said shaft for the opening of said tank-venting valve.

* * * * *

UNITED STATES PATENT AND TRADEMARK OFFICE

CERTIFICATE OF CORRECTION

PATENT NO. : 5,803,053

DATED : September 8, 1998

INVENTOR(S) : Helmut Pflieger and Georg Mallebrein

It is certified that error appears in the above-identified patent and that said Letters Patent is hereby corrected as shown below:

In column 1, line 18: between "in" and "low", insert -- the --.

In column 1, line 32: delete "A" and substitute -- λ -- therefor.

In column 3, line 27: delete "spatial" and substitute -- spatially -- therefor.

In column 3, line 59: delete "the".

In column 4, line 43: delete "and" and substitute -- which -- therefor.

Signed and Sealed this

Seventh Day of September, 1999

*Attest:*

Q. TODD DICKINSON

*Attesting Officer*

*Acting Commissioner of Patents and Trademarks*